US012127662B2

(12) United States Patent
Hong

(10) Patent No.: US 12,127,662 B2
(45) Date of Patent: Oct. 29, 2024

(54) REFILLABLE STICK FOUNDATION CONTAINER

(71) Applicant: ACOSPACK CO., LTD., Gyeonggi-do (KR)

(72) Inventor: Jung Min Hong, Seoul (KR)

(73) Assignee: ACOSPACK CO., LTD., Gyeonggi-do (KR)

( * ) Notice: Subject to any disclaimer, the term of this patent is extended or adjusted under 35 U.S.C. 154(b) by 0 days.

(21) Appl. No.: 17/780,641

(22) PCT Filed: Mar. 18, 2022

(86) PCT No.: PCT/KR2022/003790

§ 371 (c)(1),
(2) Date: May 27, 2022

(87) PCT Pub. No.: WO2023/085526

PCT Pub. Date: May 19, 2023

(65) Prior Publication Data

US 2024/0156234 A1 May 16, 2024

(30) Foreign Application Priority Data

Nov. 15, 2021 (KR) ..... 10-2021-0156819

(51) Int. Cl.
*A45D 40/06* (2006.01)
*A45D 40/00* (2006.01)

(52) U.S. Cl.
CPC ..... *A45D 40/06* (2013.01); *A45D 2040/0031* (2013.01); *A45D 2040/0043* (2013.01)

(58) Field of Classification Search
CPC ..... A45D 40/06; A45D 2040/0043; A45D 40/00; A45D 2040/0025;
(Continued)

(56) References Cited

U.S. PATENT DOCUMENTS 4,884,912 A * 12/1989 Gueret ..... A45D 40/06 401/86
5,399,040 A * 3/1995 Holloway ..... A45D 40/06 401/86
(Continued)

FOREIGN PATENT DOCUMENTS

JP 2016096875 A 5/2016
KR 20-0262465 B1 1/2002
(Continued)

*Primary Examiner* — David J Walczak
(74) *Attorney, Agent, or Firm* — DUANE MORRIS LLP; Gregory M. Lefkowitz

(57) ABSTRACT

A refillable stick foundation container is provided. The refillable stick foundation container includes; an assembly accommodating a stick foundation and having a latching protrusion protruding downward from the lower surface thereof; a rotary tube accommodating the assembly inserted thereinto such that the lower surface of the assembly is seated on the bottom thereof, having an open hole which is formed at the bottom thereof and into which the latching protrusion is inserted, and rotating relative to the assembly such that the stick foundation is upwardly exposed or hidden; and a coupling block laterally slidably inserted into and in close contact with the lower surface of the rotary tube and having a latching portion which is formed on the upper surface thereof and to which the latching protrusion is latched.

6 Claims, 8 Drawing Sheets

(58) Field of Classification Search
CPC ..... A45D 2040/0031; A45D 2040/005; A45D 40/16; A45D 40/21; A45D 2040/208
USPC ..... 401/75–48, 172–174
See application file for complete search history.

(56) References Cited

U.S. PATENT DOCUMENTS

| | | | | |
|---|---|---|---|---|
| 11,882,916 | B2 * | 1/2024 | Dunton | A45D 40/16 |
| 2016/0141940 | A1 | 5/2016 | Hager | |
| 2021/0137243 | A1 | 5/2021 | Nolan | |

FOREIGN PATENT DOCUMENTS

| | | | |
|---|---|---|---|
| KR | 10-0965241 | B1 | 6/2010 |
| KR | 10-2108430 | | 4/2020 |

* cited by examiner

REFILLABLE STICK FOUNDATION CONTAINER

CROSS-REFERENCE TO RELATED APPLICATIONS

This application is a § 371 national stage entry of International Application No. PCT/KR2022/003790, filed on Mar. 18, 2022, which claims priority to Korean Patent Application No. 10-2021-0156819, filed on Nov. 15, 2021, the entire contents of which are incorporated herein by reference.

BACKGROUND OF THE INVENTION

1. Field of the Invention

The present invention relates to a refillable stick foundation container.

2. Description of the Related Art

Foundation is a cosmetic product that is used to naturally conceal blemishes or melasma on exposed areas of the skin such as the face or to make the skin look clean and beautiful or clear and soft.

For good foundation makeup, the foundation needs to be evenly applied to the skin without clumping. To this end, the user uses a cosmetic puff to evenly spread the foundation on the skin.

Usually, the foundation is accommodated in a flat container for storage and the puff is placed inside the container.

The user uses the foundation accommodated in the container with the puff. However, the repeated use of the puff frequently causes contamination of the puff, leading to contamination of the foundation. Thus, stick foundations have been developed whose cleanliness can be maintained and managed.

Since higher costs are required to manufacture the containers of the stick foundations than to prepare the contents of the stick foundations, disposal of the stick foundation containers after the stick foundations are used up leads to very large economic losses.

Thus, more research needs to be conducted on a refillable stick foundation container designed such that the stick foundation is replaced with a new one after using a certain amount of the old stick foundation.

PRIOR ART DOCUMENTS (Patent Document 1) Korean Utility Model Registration No. 20-0262465

SUMMARY OF THE INVENTION

It is an object of the present invention to provide a refillable stick foundation container designed such that the stick foundation is easily replaced with a new one.

One aspect of the present invention provides a refillable stick foundation container, including; an assembly accommodating a stick foundation and having a latching protrusion protruding downward from the lower surface thereof; a rotary tube accommodating the assembly inserted thereinto such that the lower surface of the assembly is seated on the bottom thereof, having an open hole which is formed at the bottom thereof and into which the latching protrusion is inserted, and rotating relative to the assembly such that the stick foundation is upwardly exposed or hidden; and a coupling block laterally slidably inserted into and in close contact with the lower surface of the rotary tube and having a latching portion which is formed on the upper surface thereof and to which the latching protrusion is latched.

The latching protrusion may include a web extending downward from the lower surface of the assembly and a flange extending horizontally from the distal end of the web; and the latching portion may include a latching groove into which the web and the flange are laterally slidably inserted and which limits the upward and downward movements of the flange.

The assembly may include: a foundation holder having an accommodation part accommodating the stick foundation and at least one pair of guide projections formed opposite to each other on the outer circumferential surface of the accommodation part; a guide tube accommodating the foundation holder inserted thereinto and having guide slots into which the guide projections are inserted such that the ascent and descent of the foundation holder are guided; and a rotary body inserted into the foundation holder, having a plurality of helical protrusions formed parallel to each other in the height direction on the outer circumferential surface thereof such that a fitting protrusion formed on the inner circumferential surface of the foundation holder is inserted thereinto, having the latching protrusion formed on the lower surface thereof, and designed such that when the rotary body rotates relative to the guide tube, the fitting protrusion slides along the helical protrusions such that the foundation holder ascends and descends, wherein the lower surface of the rotary body is seated on the bottom of the rotary tube and the latching protrusion is inserted into the open hole and latched to the latching portion.

The rotary body may further include: a first seating portion which is formed at the lower end thereof and on which the lower surface of the guide tube is seated; and a second seating portion which is stepped inwardly on the first seating portion and on which the lower surface of the foundation holder is seated.

An undercut region may be formed in the lower end portion of the guide tube where the guide slots are disposed.

An undercut region may be formed in the lower end portion of the accommodation part where the guide projections are disposed and at least one cutout hole may be formed on the outer circumferential surface of the accommodation part where the undercut region is formed.

According to exemplary embodiments of the present invention, the stick foundation can be easily replaced with a new one simply by latching or unlatching of the latching protrusion formed on the lower surface of the assembly accommodating the old stick foundation to or from the latching portion formed on the upper surface of the coupling block.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1:
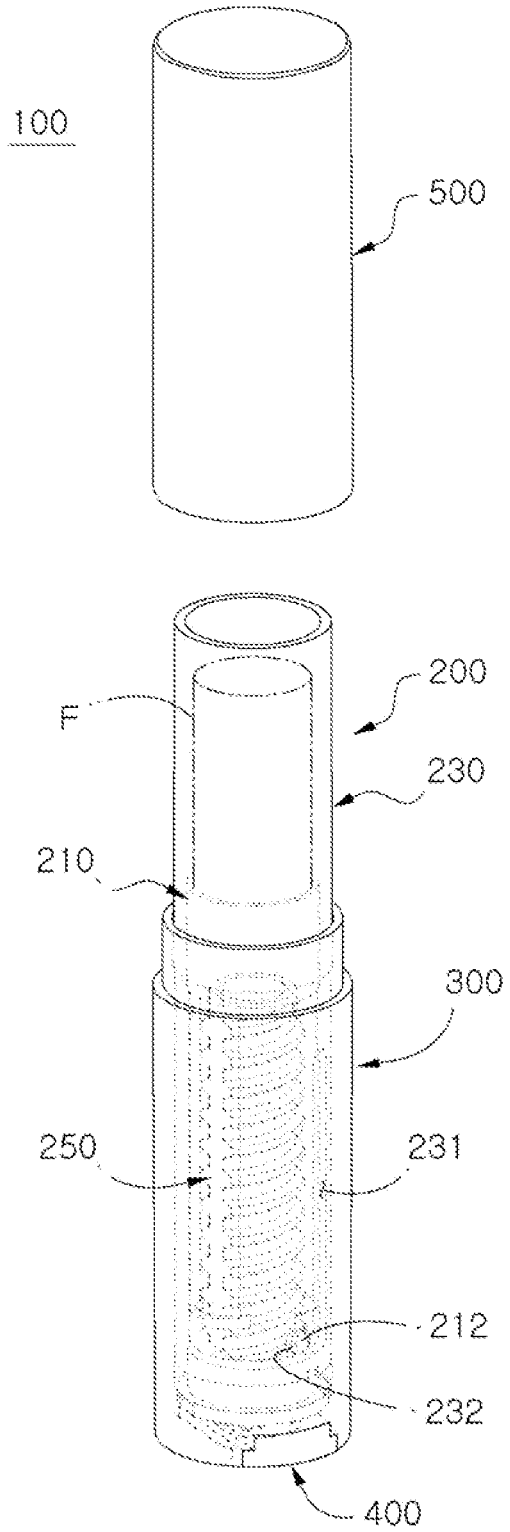
FIG. 1 is a perspective view illustrating a refillable stick foundation container according to the present invention.

In order to fully understand the present invention, the operational advantages of the present invention, and the objects to be achieved by the practice of the present invention, reference should be made to the accompanying drawings illustrating preferred embodiments of the present invention and the disclosure of the drawings.

Preferred embodiments of the present invention will be described in detail with reference to the accompanying drawings. The same reference numerals denote the same elements throughout the drawings.

Figure 2:
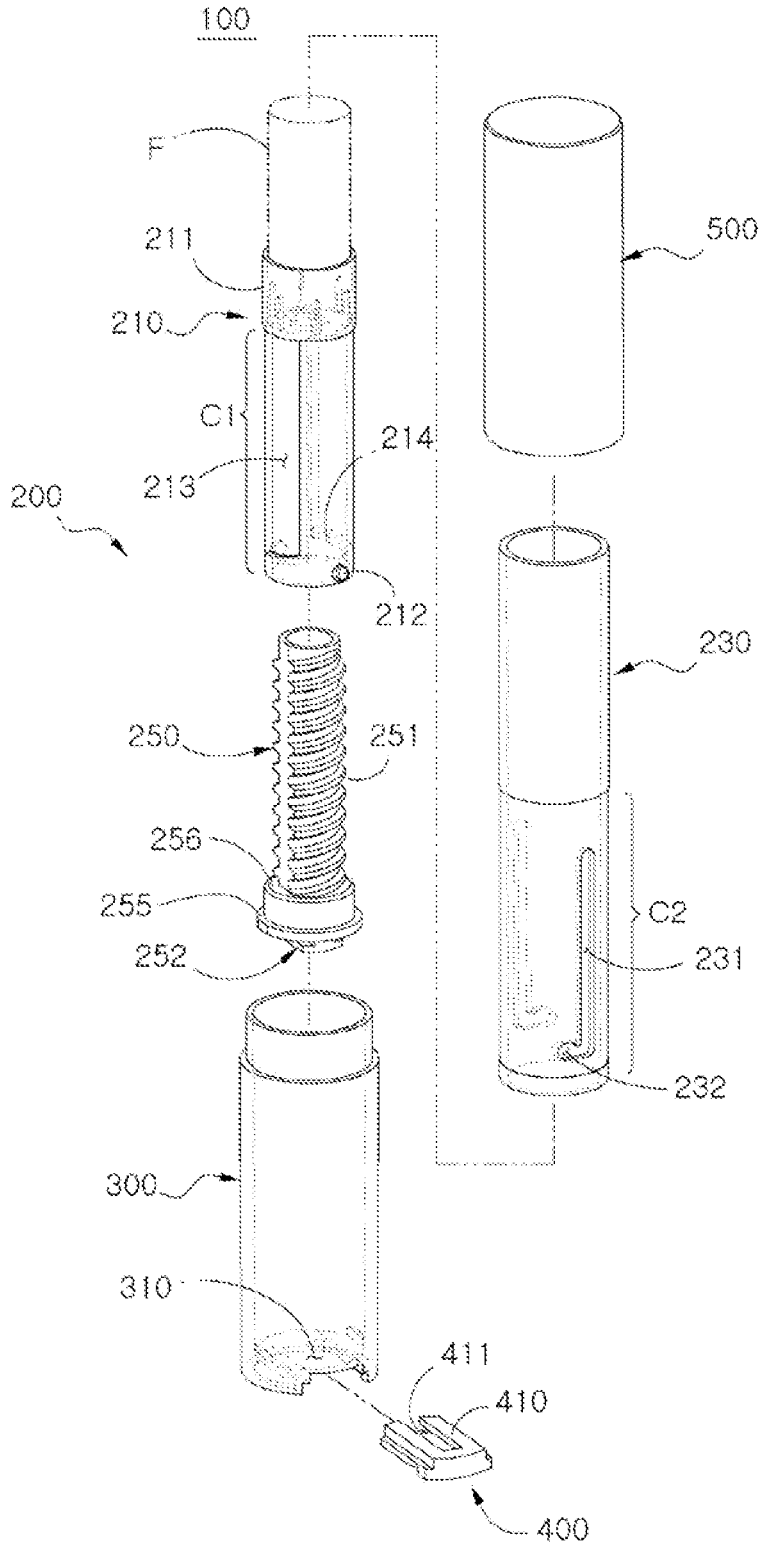
FIG. 2 is an exploded perspective view illustrating a refillable stick foundation container according to the present invention.
Figure 3:
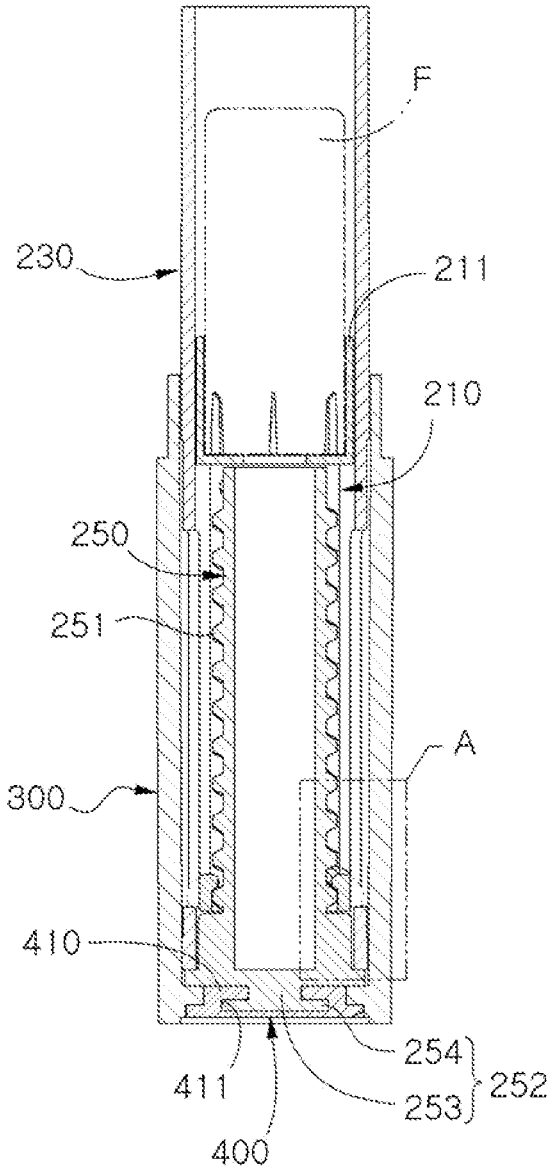
FIG. 3 is a cross-sectional view illustrating an assembled state of a refillable stick foundation container according to the present invention.
Figure 4:
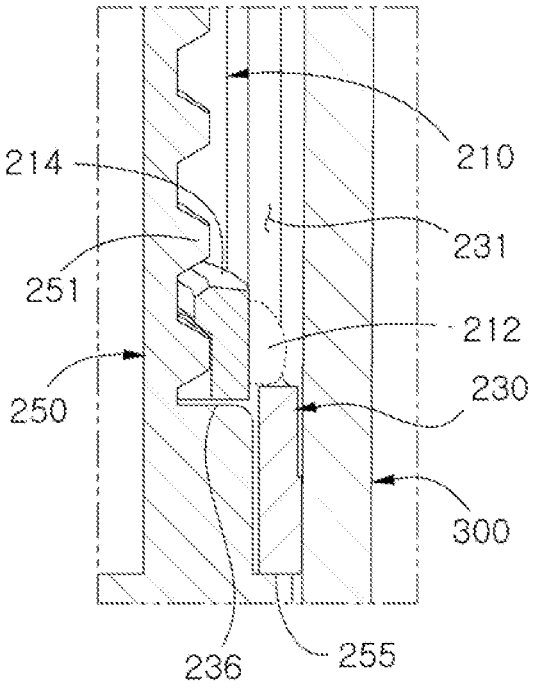
FIG. 4 is an enlarged view illustrating portion "A" of FIG. 3.
Figure 5:
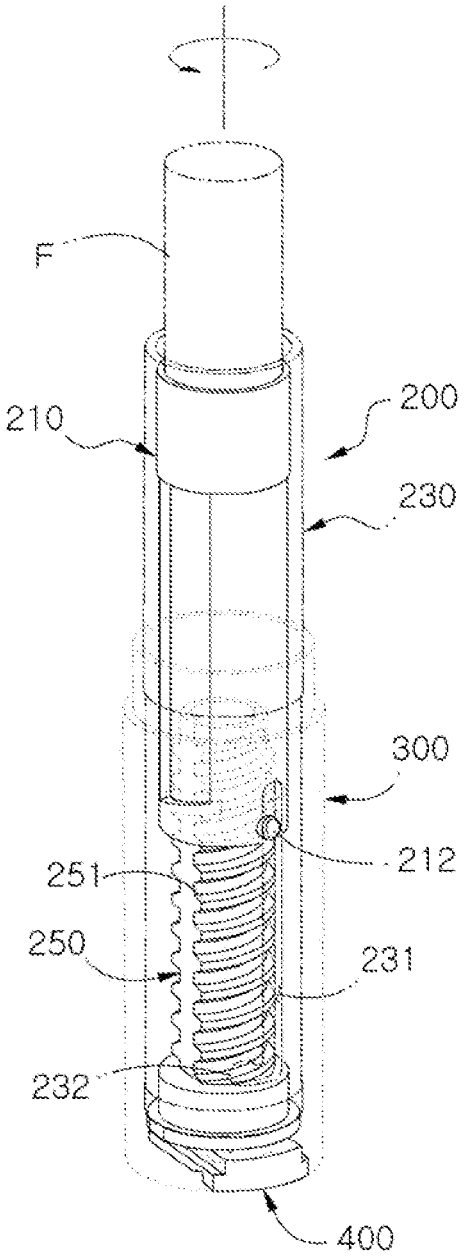
FIGS. 5 and 6 illustrate a state in which a foundation holder ascends and descends during use of a refillable stick foundation container according to the present invention, respectively.
Figure 6:
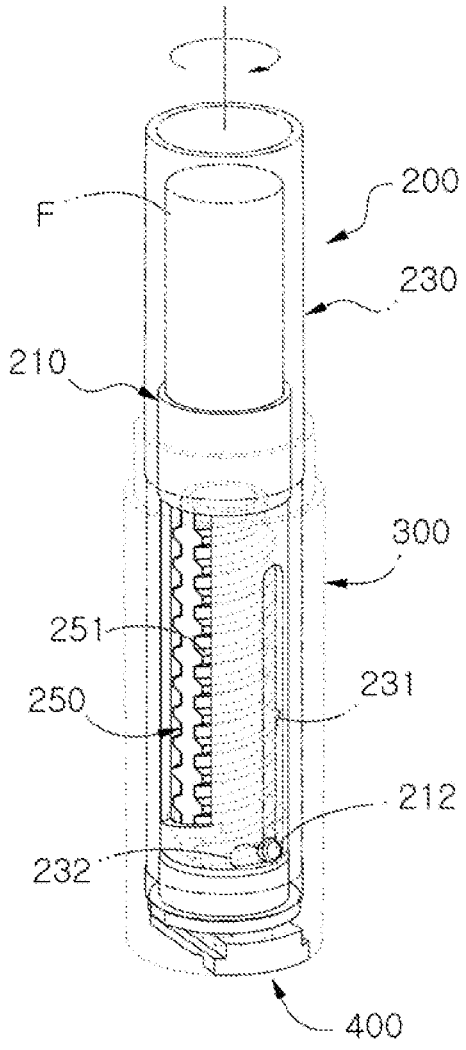
Figure 7:
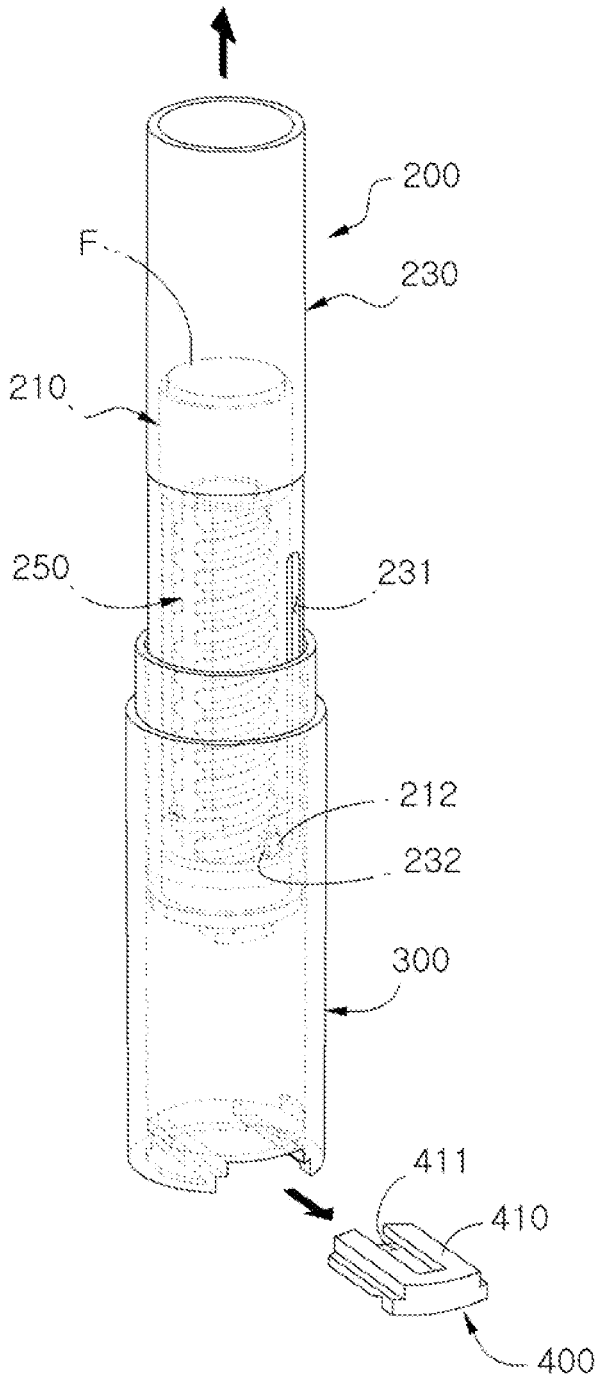
FIGS. 7 and 8 illustrate a state in which an assembly is refilled during use of a refillable stick foundation container according to the present invention.
Figure 8:
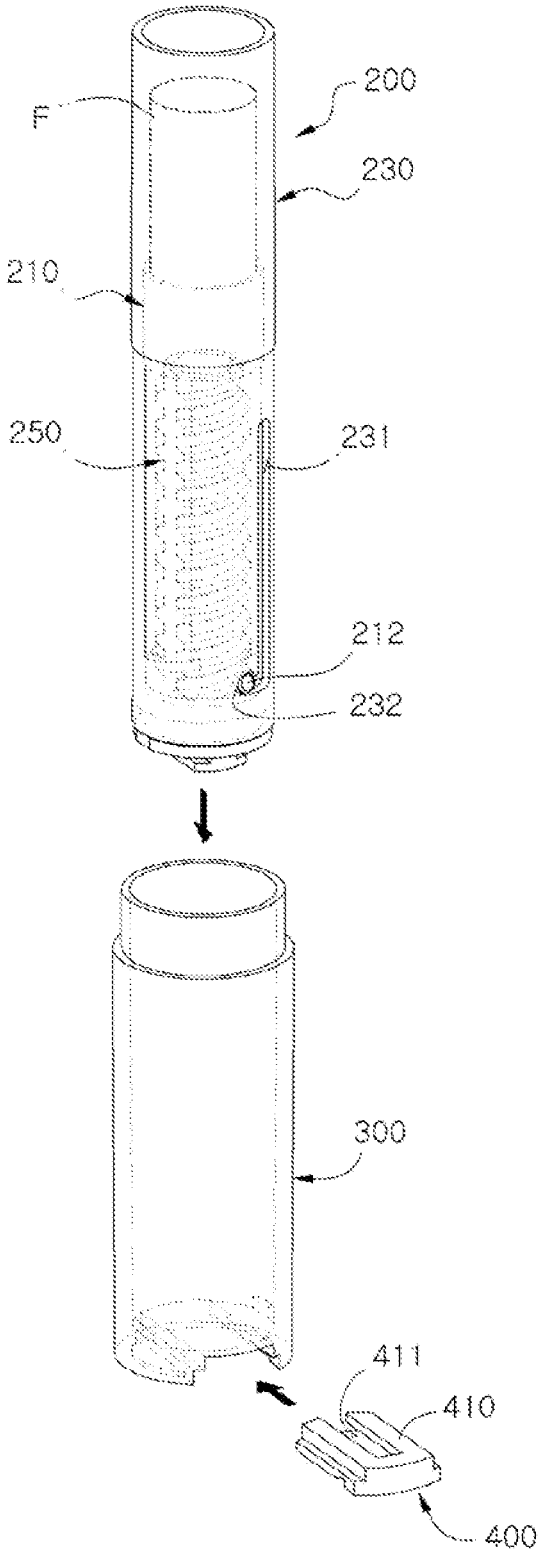

FIG. 1 is a perspective view illustrating a refillable stick foundation container according to the present invention, FIG. 2 is an exploded perspective view illustrating the refillable stick foundation container, FIG. 3 is a cross-sectional view illustrating an assembled state of the refillable stick foundation container, FIG. 4 is an enlarged view illustrating portion "A" of FIG. 3, FIGS. 5 and 6 illustrate a state in which a foundation holder ascends and descends during use of the refillable stick foundation container, respectively, and FIGS. 7 and 8 illustrate a state in which an assembly is refilled during use of the refillable stick foundation container.

Referring to FIGS. 1 to 8, the refillable stick foundation container 100 of the present invention includes: an assembly 200 accommodating a stick foundation F; a rotary tube 300 accommodating the assembly 200 inserted thereinto and rotating relative to the assembly 200 such that the stick foundation F is upwardly exposed or hidden; a coupling block 400 laterally slidably inserted into the lower surface of the rotary tube 300 and latched to the lower surface of the assembly 200; and a cap member 500 detachably coupled to the upper portion of the rotary tube 300.

According to this embodiment, the stick foundation F accommodated in the assembly 200 is exposed and hidden when the rotary tube 300 rotates relative to the assembly 200.

The assembly 200 is formed by integrally assembling a foundation holder 210, a guide tube 230, and a rotary body 250.

Specifically, the assembly 200 includes: a foundation holder 210 having an accommodation part 211 accommodating the stick foundation F and at least one pair of guide projections 212 formed opposite to each other on the outer circumferential surface of the accommodation part 211; a guide tube 230 accommodating the foundation holder 210 inserted thereinto and having guide slots 231 into which the guide projections 212 are inserted such that the ascent and descent of the foundation holder 210 are guided; and a rotary body 250 inserted into the foundation holder 210, having a plurality of helical protrusions 251 formed parallel to each other in the height direction on the outer circumferential surface thereof such that a fitting protrusion 214 formed on the inner circumferential surface of the foundation holder 210 is inserted thereinto, having a latching protrusion 252 formed on the lower surface thereof, and designed such that when the rotary body 250 rotates relative to the guide tube 230, the fitting protrusion 214 slides along the helical protrusions 251 such that the foundation holder 210 ascends and descends.

According to this embodiment, the foundation holder 210 accommodates the stick foundation F and ascends and descends such that the stick foundation F is exposed and hidden, respectively, when the rotary body 250 rotates relative to the rotary tube 300.

The accommodation part 211 of the foundation holder 210 has an open top end through which the stick foundation is inserted, accommodates the stick foundation therein, and is inserted into the guide tube 230 such that it ascends and descends; and the at least one pair of guide projections 212 of the foundation holder 210 are formed opposite to each other on the outer circumferential surface of the lower end of the accommodation part 211 and protrude from the outer lateral surface of the accommodation part 211. In this embodiment, the accommodation part may be integrally formed with the guide projections 212 but the scope of the invention is not limited thereto.

The guide projections 212 are inserted into the guide slots 231 formed in the guide tube in the height direction and ascend and descend along the guide slots 231 when the rotary body rotates relative to the guide tube 230.

An undercut region C1 may be formed in the lower end portion of the accommodation part 211 where the guide projections 212 are disposed. The formation of the undercut region facilitates insertion of the accommodation part 211 into the guide tube 230.

At least one cutout hole 213 may be formed on the outer circumferential surface of the accommodation part 211 where the undercut region C1 is formed. The formation of the cutout hole provides elasticity to the accommodation part 211, making insertion of the accommodation part into the guide tube 230 easier.

According to this embodiment, the guide tube 230 guides the foundation holder 210 inserted thereinto to ascend and descend in the height direction.

The guide slots 231 of the guide tube 230 are formed along the height direction and the guide projections 212 are inserted thereinto. The number of the guide slots 231 corresponds to the number of the guide projections 212. The guide projections 212 inserted into the guide slots 231 ascend and descend along the guide slots 231 while the rotary body 250 rotates relative to the guide tube 230.

Lower horizontal slots 232 may be further formed in the guide tube 230 to limit the descent of the guide projections 212. As the foundation holder 210 ascends, the guide projections 212 ascend along the guide slots 231 in the height direction, as illustrated in FIG. 5. As the foundation holder 210 descends, the guide projections 212 descend along the guide slots 231 and are inserted into the lower horizontal slots 232 extending from the guide slots 231 such that the descent of the foundation holder 210 is limited, as illustrated in FIG. 6.

An undercut region C2 is formed in the lower end portion of the guide tube 230. The formation of the undercut region C2 facilitates insertion of the lower end portion of the guide tube into the rotary tube 300, which will be described below. The guide slots 231 are formed along the height direction in the undercut region C2.

According to the present embodiment, the rotary body 250 is inserted into the foundation holder 210 and allows the foundation holder 210 to ascend and descend.

The plurality of helical protrusions 251 are formed parallel to each other in the height direction on the outer circumferential surface of the rotary body 250. The helical protrusions 251 formed on the outer circumferential surface of the rotary body 250 may have an irregular shape in which grooves and ridges are alternately formed.

The fitting protrusion 214 formed on the inner circumferential surface of the accommodation part 211 is fitted between the helical protrusions 251 and slides along the helical protrusions 251 such that the foundation holder 210 ascends and descends stably.

In this embodiment, one fitting protrusion 214 is formed on the inner circumferential surface of the lower end of the accommodation part 211. Alternatively, one or more fitting protrusions 214 parallel to each other may be formed in the height direction on the inner circumferential surface of the lower end of the accommodation part 211. However, the scope of the invention is not limited by the number of the fitting protrusions 214.

The foundation holder 210, the rotary body 250, and the guide tube 230 are assembled together to form the assembly 200. In the assembly 200, the rotary body 250, the foundation holder 210, and the guide tube 230 are sequentially arranged from the inside to the outside. The rotary body 250 further includes: a first seating portion 255 which is formed at the lower end thereof and on which the lower surface of the guide tube 230 is seated; and a second seating portion 256 which is stepped inwardly on the first seating portion 255 and on which the lower surface of the foundation holder 210 is seated. The formation of the first and second seating portions enables the rotary body 250, the foundation holder 210, and the guide tube 230 to form one package. In a state in which the foundation holder 210, the rotary body 250, and the guide tube 230 are assembled together, the lower surface of the foundation holder 210 is seated on the second seating portion and the guide tube 230 is seated on the first seating portion 255.

As described above, the assembly 200 in which the foundation holder 210, the rotary body 250, and the guide tube 230 are integrally assembled together is inserted into the rotary tube 300 through the top of the rotary tube 300. As such, the assembly 200 can be easily coupled to the rotary tube 300 simply by inserting the assembly 200 into the rotary tube 300.

When the user rotates the rotary tube 300 coupled with the assembly 200 in the forward and reverse directions while holding the assembly 200, the rotary body 250 rotates relative to the rotary tube 300 and the foundation holder 210 ascends and descends, respectively.

For coupling of the assembly 200 to the rotary tube 300, the latching protrusion 252 is formed on the lower surface of the assembly 200, specifically on the lower surface of the rotary body 250, and an opening hole 310 is formed at the bottom of the rotary tube 300. When the assembly 200 is inserted into the rotary tube 300 through the top of the rotary tube 300, the latching protrusion 252 is inserted into the opening hole 310 formed at the bottom of the rotary tube 300.

For coupling between the assembly 200, specifically the rotary body 250, and the rotary tube 300, the coupling block 400 includes a latching portion 410 which is formed on the upper surface thereof and to which the latching protrusion 252 is latched.

The latching portion 410 formed on the upper surface of the coupling block 400 is laterally slidably inserted into and in close contact with the lower surface of the rotary tube 300. When the latching protrusion 252 is latched to the latching portion 410, the upward and downward movements of the rotary body 250 are limited.

For this purpose, the latching protrusion 252 includes a web 253 extending downward from the lower surface of the assembly and a flange 254 extending horizontally from the distal end of the web 253 (see FIG. 3); and the latching portion 410 includes a latching groove 411 into which the web 253 and the flange 254 are laterally slidably inserted and which limits the upward and downward movements of the flange 254.

As illustrated in FIG. 7, when the user wants to replace the stick foundation F with a new one after use, the user horizontally slides the coupling block 400 in close contact with the lower surface of the rotary tube 300 and latched to the latching protrusion 252 of the rotary body 250 to separate the assembly 200 and the rotary tube 300. Then, the assembly 200 arranged in the rotary tube 300 is removed from the rotary tube 300.

As illustrated in FIG. 8, the assembly 200 accommodating a new stick foundation F is inserted into the rotary tube 300 through the top of the rotary tube 300 and the latching protrusion formed on the lower surface of the rotation body 250 is inserted into the open hole 310 formed at the bottom of the rotary tube 300. Then, the coupling block 400 is laterally slidably inserted into the lower surface of the rotary tube 300 and the latching protrusion 252 formed on the lower surface of the rotary body 250 and including the web 253 and the flange 254 is inserted into and latched to the latching groove 411 formed on the upper surface of the coupling block 400 (see FIG. 3).

As described above, in the present embodiment, the assembly 200 can be easily coupled to and decoupled from the rotary tube 300 simply by laterally sliding the coupling block 400 into the lower surface of the rotary tube 300, facilitating replacement of the stick foundation F with a new one.

Those skilled in the art will appreciate that the present invention is not limited to the described embodiments and various modifications and variations are possible without departing from the scope and spirit of the invention. Accordingly, such modifications and variations are intended to come within the scope of the appended claims.

According to the present invention, the stick foundation can be easily replaced with a new one simply by latching or unlatching of the latching protrusion formed on the lower surface of the assembly accommodating the old stick foundation to or from the latching portion formed on the upper surface of the coupling block.

What is claimed is:

1. A refillable stick foundation container, comprising; an assembly accommodating a stick foundation and having a latching protrusion protruding downward from a lower surface of the assembly; a rotary tube accommodating the assembly inserted thereinto such that the lower surface of the assembly is seated on a bottom of the rotary tube, having an open hole which is formed at the bottom of the rotary tube and into which the latching protrusion is inserted, and rotating relative to the assembly such that the stick foundation is upwardly exposed or hidden; and a coupling block laterally slidably inserted into a lower surface of the rotary tube and having a latching portion which is formed on an upper surface of the rotary tube and to which the latching protrusion is latched.

2. The refillable stick foundation container according to claim 1, wherein the latching protrusion comprises a web extending downward from the lower surface of the assembly and a flange extending horizontally from a distal end of the web; and the latching portion comprises a latching groove into which the web and the flange are laterally slidably inserted and which limits an upward and downward movements of the flange.

3. The refillable stick foundation container according to claim 2, wherein the assembly comprises: a foundation holder having an accommodation part accommodating the stick foundation and at least one pair of guide projections formed opposite to each other on an outer circumferential surface of the accommodation part; a guide tube accommodating the foundation holder inserted thereinto and having guide slots into which the guide projections are inserted such that an ascent and descent of the foundation holder are guided; and a rotary body inserted into the foundation holder, having a plurality of helical protrusions formed parallel to each other in a height direction on an outer circumferential surface of the rotary body such that a fitting protrusion formed on an inner circumferential surface of the foundation holder is inserted into the helical protrusions, having the latching protrusion formed on the lower surface of the assembly, and designed such that when the rotary body rotates relative to the guide tube, the fitting protrusion slides along the helical protrusions such that the foundation holder ascends and descends, wherein a lower surface of the rotary body is seated on a bottom of the rotary tube and the latching protrusion is inserted into the open hole and latched to the latching portion.

4. The refillable stick foundation container according to claim 3, wherein the rotary body further comprises: a first seating portion which is formed at a lower end of the rotary body and on which a lower surface of the guide tube is seated; and a second seating portion which is stepped inwardly on the first seating portion and on which the lower surface of the foundation holder is seated.

5. The refillable stick foundation container according to claim 3, wherein an undercut region is formed in a lower end portion of the guide tube where the guide slots are disposed.

6. The refillable stick foundation container according to claim 3, wherein an undercut region is formed in a lower end portion of the accommodation part where the guide projections are disposed and at least one cutout hole is formed on the outer circumferential surface of the accommodation part where the undercut region is formed.

* * * * *